US012752885B2

(12) United States Patent
Clayton

(10) Patent No.: US 12,752,885 B2
(45) Date of Patent: Oct. 6, 2026

(54) WATERCRAFT BAFFLE ARRANGEMENT SYSTEM

(71) Applicant: Robert Clayton, Yuma, AZ (US)

(72) Inventor: Robert Clayton, Yuma, AZ (US)

( * ) Notice: Subject to any disclaimer, the term of this patent is extended or adjusted under 35 U.S.C. 154(b) by 417 days.

(21) Appl. No.: 18/236,942

(22) Filed: Aug. 22, 2023

(65) Prior Publication Data

US 2024/0059380 A1 Feb. 22, 2024

Related U.S. Application Data

(60) Provisional application No. 63/400,018, filed on Aug. 22, 2022.

(51) Int. Cl.
*B63B 32/64* (2020.01)
*B63B 32/22* (2020.01)

(52) U.S. Cl.
CPC ..... *B63B 32/64* (2020.02); *B63B 32/22* (2020.02)

(58) Field of Classification Search
CPC ..... B64B 32/00; B64B 32/20; B64B 32/22; B64B 32/64; B63B 32/00; B63B 32/20; B63B 32/22; B63B 32/64
See application file for complete search history.

(56) References Cited

U.S. PATENT DOCUMENTS

2015/0210371 A1* 7/2015 Rabinovich ..... B63B 32/64 114/140

FOREIGN PATENT DOCUMENTS

GB 2522394 A * 7/2015 ..... B63B 32/50

* cited by examiner

*Primary Examiner* — Justin Michael Heston

(57) ABSTRACT

A surfboard baffle arrangement system may be provided utilizing a watercraft body having a first side surface and a second side surface. The surfboard baffle arrangement system may further utilize an array of baffle structures disposed into the watercraft body and through the first side surface. Each baffle structure within the array of baffle structures may have a baffle retainer and a baffle panel such that the baffle panel and the baffle retainer may be operably coupled to one another. Further, the baffle panel may have one degree of freedom of rotation relative the baffle retainer such that the one degree of freedom of rotation utilizes rotation of the baffle panel between an open configuration and a closed configuration.

16 Claims, 11 Drawing Sheets

WATERCRAFT BAFFLE ARRANGEMENT SYSTEM

CROSS-REFERENCE TO RELATED APPLICATIONS

This application claims priority to U.S. Provisional Patent Application Ser. No. 63/400,018, entitled "Surfboard Baffle Arrangement System," filed Aug. 22, 2022. The contents of this application are hereby incorporated by reference in their entirety.

BACKGROUND OF THE INVENTION

Any watercraft, including boats, kayaks, paddleboards, bodyboards, surfboards, may experience several problems when it comes to a user getting aboard and staying balanced upright when on water. Some of these issues include: wind creating choppy water causing the watercraft to drift, which can throw off balance making it more difficult to maintain control; waves causing the watercraft to rock making it challenging to maintain stability; strong currents creating unpredictable movements in the water which pulls the watercraft in different directions; proper weight distribution to keep the watercraft upright; and high travel speeds can also create more wind resistance which can make it more difficult to maintain control on top of the watercraft.

For instance, learning how to paddlebaord, bodyboard or surf for the first time can be a fun and exciting experience, but it can also be challenging. Some common problems that beginners may face when learning to surf water upon a watercraft include balancing on the board and choosing the right waves. Beginners can experience several specific issues when it comes to balancing on the board while surfing. Some of these balance issues can include timing, positioning, posture, foot placement, board size and shape and the like.

Balancing on the board requires good timing. Beginners may find it challenging to time their movements with the motion of the wave, which can make it difficult to stay balanced. Correct positioning on the board is crucial for maintaining balance. Beginners may find it challenging to find the sweet spot on the board, or the area where the board is most stable. Proper posture is also essential for maintaining balance on the board. Beginners may find it challenging to keep their weight centered and to maintain a low center of gravity. Foot placement is crucial for balance and control on the board. Beginners may have difficulty finding the right position for their feet or shifting their weight between their feet. The size and shape of the board can also impact balance. Beginners may find it easier to balance on a larger, more stable board, while a smaller or more advanced board may be more challenging to balance on. Therefore, it would be advantageous to provide a system for assisting the user in climbing and balancing upon a watercraft such as a bodyboard or surfboard while further aiding in the control of the watercraft once aboard.

Choosing the right waves is crucial for beginners to catch waves and have a successful surfing experience. Some specific issues that beginners may experience when trying to choose the right waves include identifying the wave pattern, fear of large waves, position relative the chosen wave, timing issues, competition with other surfers and the like. Beginners may have trouble distinguishing between waves that are too small or too big to ride, and waves that are the right size and shape for their skill level. This can make it challenging to choose the right wave to ride. Some beginners may be hesitant to try to catch larger waves, which can limit their ability to find waves that are the right size and shape for their skill level. To catch a wave, a surfer needs to position themselves in the right spot in the water.

Further, beginners may not know how to read the water or may not understand the proper positioning needed to catch a wave. Catching a wave also requires good timing. Beginners may struggle to time their paddling and positioning correctly, which can make it difficult to catch waves. In crowded surf spots, beginners may have to compete with other surfers to catch waves. This can make it challenging to find the right wave to ride, especially if more experienced surfers are also vying for the same waves. Therefore, it would be advantageous to provide a system for allowing a user to be able to surf a wider range of waves, big or small, in a user-friendly manner while still enjoying the experience.

Additionally, while the amount of time it takes a user new to surfing to learn how to surf varies depending on several factors, including the user's natural ability, physical fitness, and the quality and frequency of instruction they receive, it is known that on average the user developing a skillset in this area takes a considerable amount of time. For example, it usually takes several weeks to a few months to learn the basics of surfing and become proficient enough to ride small waves consistently. With dedicated practice and regular coaching, beginners may progress to catching unbroken waves and maneuvering the board after about six months to a year of consistent surfing.

Further, at the intermediate level, surfers have a good understanding of wave selection, proper positioning, and basic maneuvers such as bottom turns and cutbacks. It typically takes a few years of regular surfing to progress to an intermediate level, although some may achieve this level in less time if they surf frequently and receive regular coaching. However, surfing at an expert level requires a high level of skill, physical fitness, and commitment. Experts are proficient in a wide range of maneuvers, such as aerials, tube rides, and off-the-flange maneuvers, and can surf in challenging conditions such as big waves and strong currents. Achieving an expert level can take several years of dedicated practice, and many surfers never reach this level. Therefore, it would be advantageous to provide a system for allowing a user to learn to surf and achieve beginner, intermediate and expert levels in a more efficient and timely manner relative the average timeline.

Moreover, young children learning to surf water upon a watercraft may face challenges including a lack of physical strength to paddle out to larger waves, a lack of skill to surf larger waves, an inability to handle the pace and scale of larger waves and the like. However, significantly smaller waves are generally harder to surf in that it is more difficult to climb the watercraft and stay aboard with a slow-paced small scale wave. Further, for these reasons, it is generally less enjoyable to surf these small waves and so young children can be more easily deterred from trying to learn to surf to begin with. Therefore, it would be advantageous to provide a watercraft system that allows a younger user to successfully surf a smaller wave and, thereafter, to enjoy surfing the small wave in order to encourage the younger user to begin and continue to learn how to surf.

DETAILED DESCRIPTION OF THE INVENTION

Figure 1:
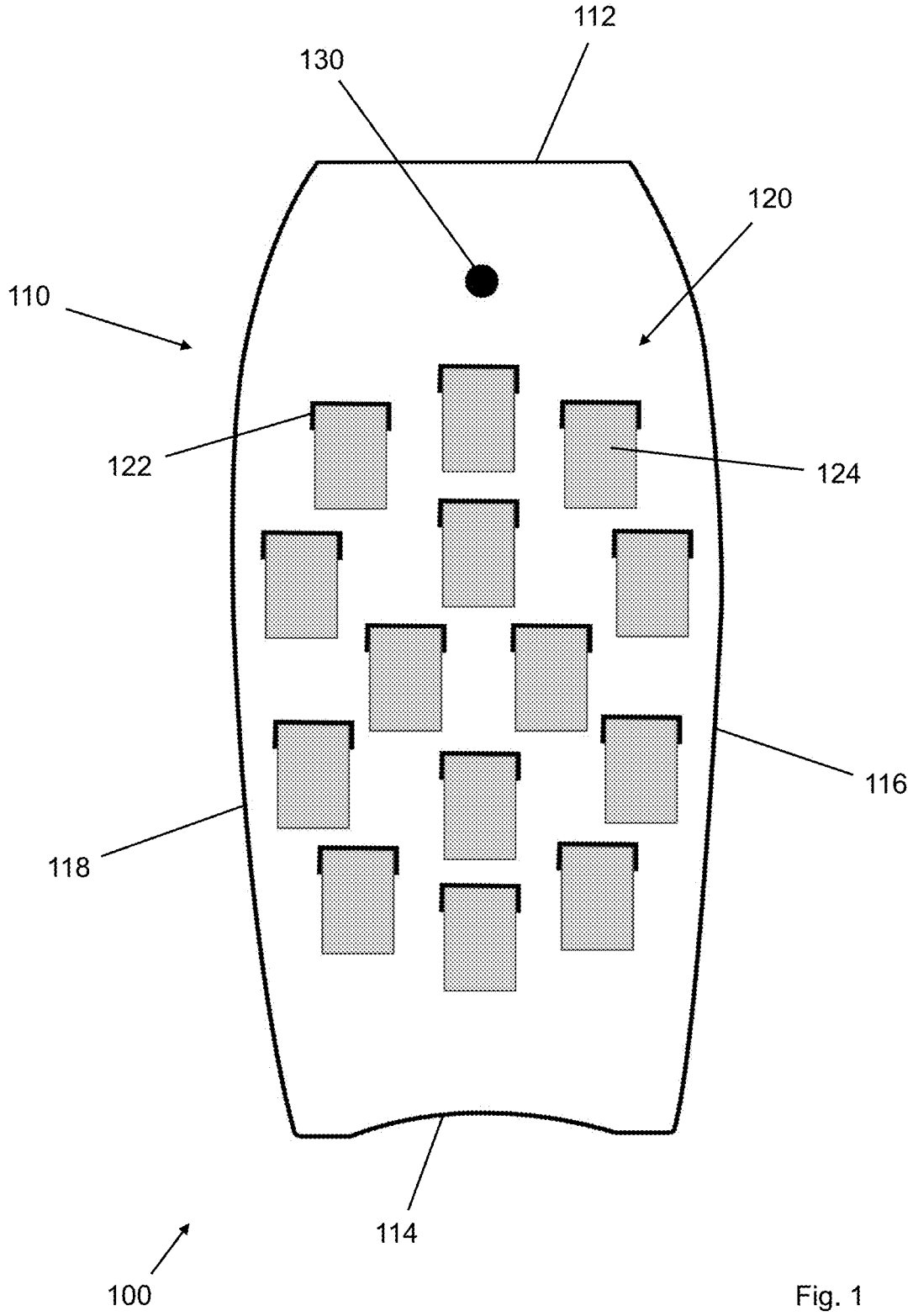
FIG. 1 illustrates a plan view of a first side surface of a watercraft baffle arrangement system in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a watercraft baffle arrangement system" also includes a plurality of watercraft baffle arrangement systems and the like.

In some embodiments of FIGS. 1-11D, a surfboard baffle arrangement system is provided comprising: a watercraft body having a first side surface and a second side surface; and an array of baffle structures disposed into the watercraft body and through the first side surface, wherein: each baffle structure within the array of baffle structures comprises a baffle retainer and a baffle panel, the baffle panel and the baffle retainer are operably coupled to one another, the baffle panel comprises one degree of freedom of rotation relative the baffle retainer, and the one degree of freedom of rotation comprises rotation of the baffle panel between an open configuration and a closed configuration.

In some embodiments of FIGS. 1-11D, the first side surface is opposite the second side surface, the array of baffle structures is disposed into the watercraft body and through the first side surface but not the second side surface, the baffle retainer comprises a housing and a perimeter flange, and the housing and the perimeter flange are permanently coupled to one another.

In some embodiments of FIGS. 1-11D, the housing comprises a first wall having a lower concave portion defining an opening to a cavity within the housing, the perimeter flange is disposed outside of the watercraft body and upon the first side surface, the array of baffle structures is arranged symmetric about a vertical axis running along the width-wise midpoint of the watercraft body, and the array of baffle structures is arranged asymmetric about a horizontal axis running along the length-wise midpoint of the watercraft body.

In some embodiments of FIGS. 1-11D, the baffle panel and the baffle retainer are operably coupled to one another via a coupling rod, the coupling rod is secured to the baffle retainer via a plurality of coupling apertures formed within the baffle retainer, the baffle retainer comprises a housing and a perimeter flange, and the plurality of coupling apertures are disposed within opposing second and third walls of the housing, and the plurality of coupling apertures are aligned along a common axis.

In some embodiments of FIGS. 1-11D, the common axis is aligned axially along the length of the coupling rod, the baffle retainer comprises a housing and a perimeter flange, and the coupling rod comprises one degree of freedom of rotation relative the housing, the housing comprises a first wall having a lower concave portion defining an opening to a cavity within the housing, and the coupling rod is entirely disposed within the cavity, and the baffle panel is only partially disposed within the cavity.

In some embodiments of FIGS. 1-11D, the baffle retainer comprises a housing and a perimeter flange, the housing comprises a cavity therein and each of the housing and the cavity are disposed within the watercraft body, and the perimeter flange is disposed outside of the watercraft body and upon the first side surface.

In some embodiments of FIGS. 1-11D, a surfboard baffle arrangement system is provided comprising: a watercraft body having a first side surface and a second side surface, wherein the first side surface is opposite the second side surface; and an array of baffle structures disposed into the watercraft body and through the first side surface but not the second side surface, wherein: each baffle structure within the array of baffle structures comprises a baffle retainer and a baffle panel, the baffle retainer comprises a housing and a perimeter flange, the housing and the perimeter flange are permanently coupled to one another, the baffle panel and the baffle retainer are operably coupled to one another, the baffle panel comprises one degree of freedom of rotation relative the baffle retainer, and the one degree of freedom of rotation comprises rotation of the baffle panel between an open configuration and a closed configuration.

In some embodiments of FIGS. 1-11D, a surfboard baffle arrangement system is provided comprising: a watercraft body having a first side surface and a second side surface, wherein the first side surface is opposite the second side surface; and an array of baffle structures disposed into the watercraft body and through the first side surface but not the second side surface, wherein: each baffle structure within the array of baffle structures comprises a baffle retainer and a baffle panel, the baffle retainer comprises a housing and a perimeter flange, the housing comprises a first wall having a lower concave portion defining an opening to a cavity within the housing, the perimeter flange is disposed outside of the watercraft body and upon the first side surface, the baffle panel and the baffle retainer are operably coupled to one another, the baffle panel comprises one degree of freedom of rotation relative the baffle retainer, and the one degree of freedom of rotation comprises rotation of the baffle panel between an open configuration and a closed configuration.

Exemplary embodiments of the present invention are illustrated in the accompanying figures. As shown in FIG. 1, a plan view of a first side surface 126 of a watercraft baffle arrangement system 100 is provided. The watercraft baffle arrangement system 100 may comprise a watercraft body 110 having a top side 112, a bottom side 114, a right side 116 and a left side 118. The watercraft body 110 may further comprise the first side surface 126 and an opposing second side surface. The first side surface 126 may comprise may comprise an array of baffle structures 120 disposed therein.

Each of the baffle structures in the array of baffle structures 120 may comprise a perimeter flange 122 disposed partially around a baffle panel 124 as illustrated in FIG. 1. The baffle panel 124 may be coupled to the perimeter flange 122 such that the baffle panel 124 may be able to rotate in a single degree of freedom relative the perimeter flange 122. The perimeter flange 122 may comprise a generally three-sided rectangular shape which is coupled into the first side surface 126 of the watercraft body 110 and disposed around the generally rectangular baffle panel 124. Further, the first side surface 126 of the watercraft body 110 may comprise an aperture 130 that may be utilized to retain a watercraft handle or other like accessory.

The array of baffle structures 120 may comprise a plurality of baffle structures that are arranged symmetrically about either side of a vertical axis running along the width-wise midpoint of the watercraft body 110 as illustrated in FIG. 1. The vertical axis may be defined by an axis running between the top and bottom sides 112, 114 and through the aperture 130 such that the axis is equidistant from the right and left sides 116, 118. It is advantageous that the array of baffle structures 120 be symmetrically arranged about the vertical axis so that the hydrodynamics of the baffle structures may be such that the watercraft body 110 is propelled by moving water in a symmetric manner which enables the user to best control the watercraft body 110 while surfing upon moving water.

The plurality of baffle structures of the array of baffle structures 120 may be arranged asymmetrically relative a horizontal axis running along the length-wise midpoint of the watercraft body 110 as illustrated in FIG. 1. The horizontal axis may be defined by an axis running between the right and left sides 116, 118 such that the axis is equidistant from the top and bottom sides 112, 114. It is advantageous that the array of baffle structures 120 be asymmetrically arranged about the horizontal axis given that symmetry about this axis does not affect the performance nor ease of control of the watercraft body 110 when being propelled by water that is moving in a direction orthogonal to the horizontal axis. Therefore, it would be disadvantageous to require more complexity in the design and manufacturing of the watercraft baffle arrangement system 100 when the additional complexity of symmetry about the horizontal axis would not enhance the hydrodynamic performance of the system 100 for the user surfing the moving water.

The phrase "hydrodynamic performance" refers to how well an object or structure moves through water and how it interacts with the fluid forces that act upon it. Hydrodynamics is the study of the behavior of fluids in motion, including the way that fluids flow around and through solid objects. In the context of surfing, hydrodynamic performance is a critical factor in determining how well a watercraft will perform in the water, including its speed, stability, and maneuverability. A watercraft with good hydrodynamic performance is designed to minimize drag and maximize lift, allowing the user of the watercraft to move efficiently and effectively through the water and catch the moving water with ease.

Further, the orientation of each of the baffle structures of the array of baffle structures 120 may be oriented in the same direction as illustrated in FIG. 1. Specifically, the three sides of the perimeter flange 122 may define an opening on the fourth side thereof through which the baffle panels 124 may be disposed. Each of these openings of the perimeter flanges 122 are disposed towards the bottom side 114 of the watercraft body 110 as illustrated in FIG. 1. Therefore, each of the baffle panels 124 are oriented through the openings towards the bottom side 114 of the watercraft 110.

Such a common orientation of each of the baffle structures of the array of baffle structures 120 is advantageous in order to allow each of the baffle panels 124 to catch moving water and project a common force vector upon each of the baffle panels 124 of the watercraft baffle arrangement system 100 which provides optimal control of the watercraft body 110 by the user. Further, this orientation allows the user to catch even small waves against the array of baffle structures 120 and to thereby surf such small waves with ease. If such a common vertically symmetric orientation was not utilized, then the array of baffle structures 120 would be unevenly propelled by moving water incident thereupon and thereby prevent the user from moving in the direction in which the top side 112 is aimed.

Figure 2:
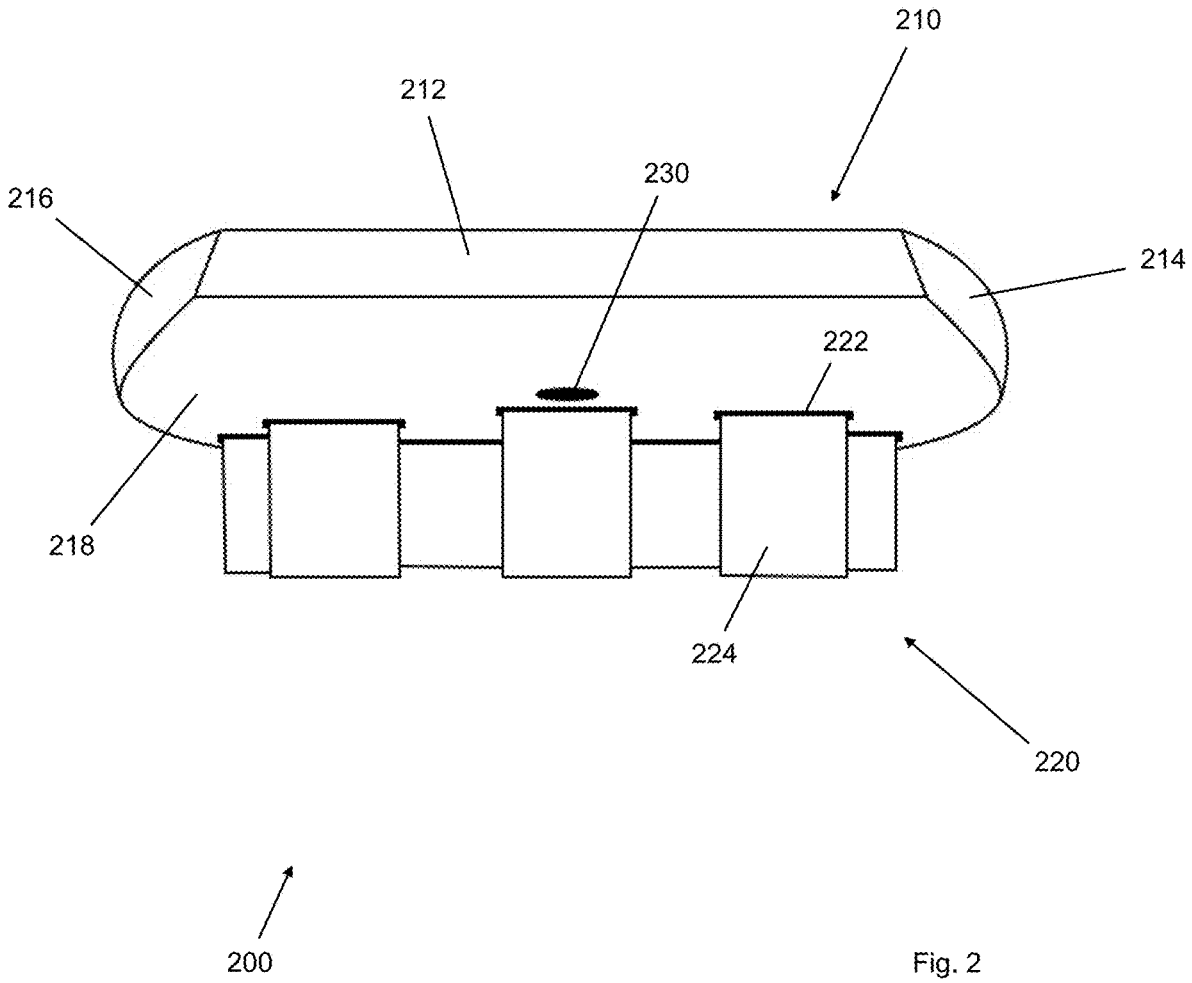
FIG. 2 illustrates an elevational perspective view of a bottom surface of a watercraft baffle arrangement system in accordance with some embodiments of the present invention.

As shown in FIG. 2, an elevational perspective view of a bottom surface 218 of a watercraft baffle arrangement system 200 is provided. The watercraft baffle arrangement system 200 may comprise a watercraft body 210 having a top side 212, a right side 214, a left side 216, a bottom side, and a first side surface 218. The watercraft body 210 may further comprise an array of of baffle structures 220 each comprising a perimeter flange 222 and an adjoined baffle panel 224. The array of baffle structures 220 may be arranged to have symmetry about a vertical axis running along the width-wise midpoint through an aperture 230 of the watercraft body 210.

The watercraft baffle arrangement system 200 of FIG. 2 may be the same as that illustrated and described with respect to FIG. 1. However, FIG. 2 illustrates the watercraft body 210 as being in an orientation where the first side surface 218 is directed downward toward a ground or water surface, whereas FIG. 1 illustrates the watercraft body 110 as being in an orientation where the bottom side 114 is directed downward toward a ground or water surface.

Therefore, in FIG. 1 each baffle panel 124 of the array of baffle structures 120, being able to rotate freely within the single degree of freedom of movement are hanging in a closed configuration. In the closed configuration, the baffle panels 124 are disposed adjacent to and in parallel with the first side surface 126 of the watercraft body 110 and are directed toward the bottom side 114 and the ground or water surface. In FIG. 2, however, each baffle panel 224 of the array of baffle structures 220, being able to rotate freely within the single degree of freedom of movement are hanging in an open configuration. In the open configuration, the baffle panels 224 are disposed away from and orthogonal to the first side surface 218 of the watercraft body 210 and are directed toward the ground or water surface.

FIG. 1 illustrates the baffle panels 124 in the closed configuration in parallel with the first side surface 126 and FIG. 2 illustrates the baffle panels 224 in the open configuration orthogonal to the first side surface 218. However, it is understood to be within the scope of this invention that the closed configuration may encompass an angular orientation of the baffle panels relative the first side surface that is within a 10 degree angle range of parallel (i.e. oriented between −10 degrees and 10 degrees relative the first side surface) and that the open configuration may encompass an angular orientation of the baffle panels relative the first side surface that is within a 10 degree angle range of orthogonal (i.e. oriented between 80 degrees and 100 degrees relative the first side surface).

Figure 3:
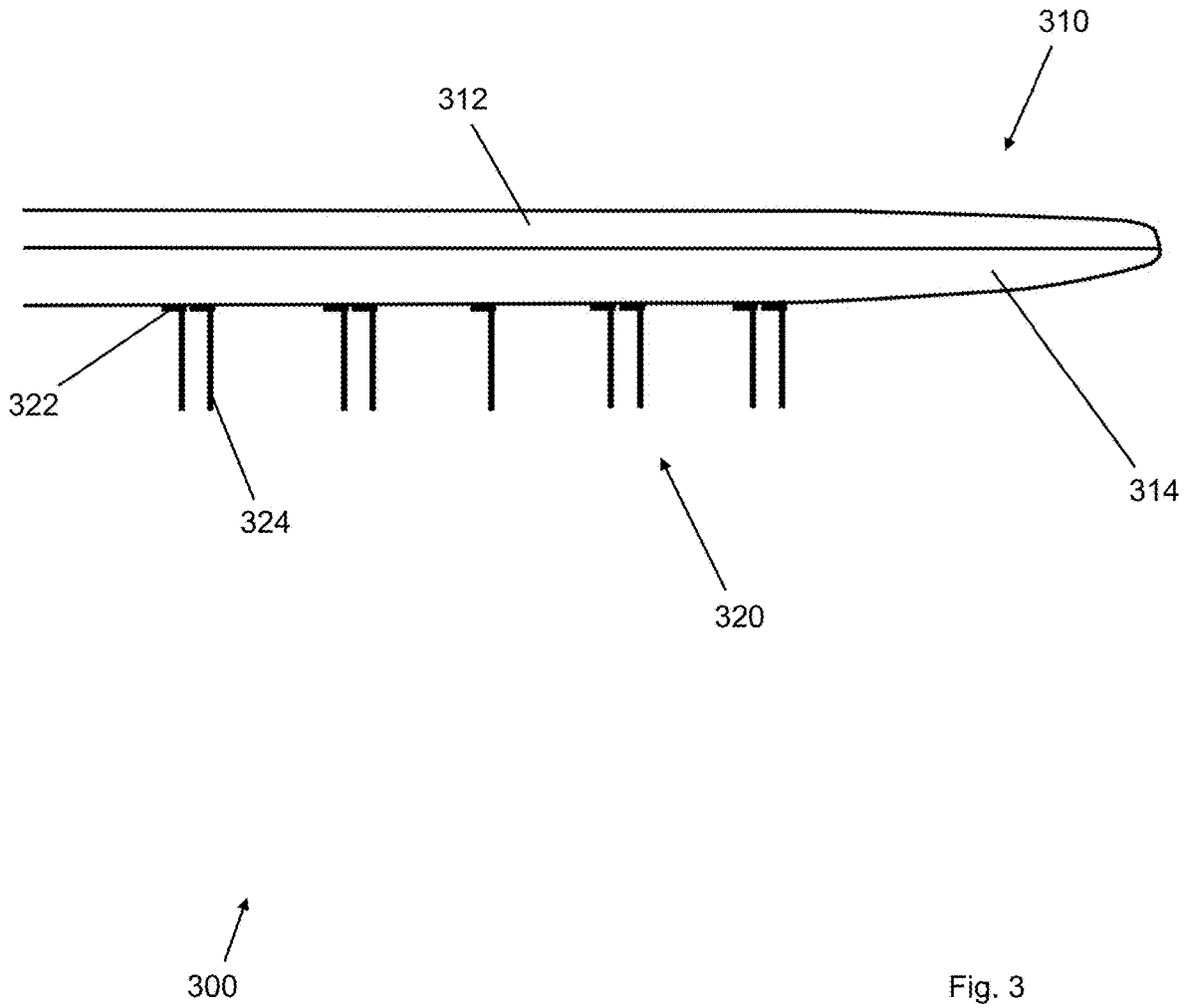
FIG. 3 illustrates a side plan view of a watercraft baffle arrangement system in accordance with some embodiments of the present invention.

As shown in FIG. 3, a side plan view of a watercraft baffle arrangement system 300 is provided. The watercraft baffle arrangement system 300 may comprise a watercraft body 310 having a first side surface 312, a second side surface 314, a front end 316 and a back end. The first side surface 312 may comprise an array of baffle structures 320 each comprising a perimeter flange 322 coupled within the first side surface 312 and a baffle panel 324 extending therefrom at an orientation that is orthogonal relative the first side surface 312.

The watercraft baffle arrangement system 300 of FIG. 3 may be the same as that illustrated and described with respect to FIG. 2 except that the side elevational view is illustrated in FIG. 3. Accordingly, the baffle panels 324 of the array of baffle structures 320 are illustrated as hanging in the open configuration in an orthogonal orientation relative the first side surface 312. Since the watercraft body 310 is illustrated in FIG. 3 as having an inwardly tapering thickness towards the front end 316, some of the baffle panels 324 of the array of baffle structures 320 may not be exactly aligned in an orthogonal orientation relative the first side surface 312. Therefore, in FIG. 3 it is similarly understood to be within the scope of this invention that the open configuration may encompass an angular orientation of the baffle panels 324 relative the first side surface 312 that is within a 10 degree angle range of orthogonal (i.e. oriented between 80 degrees and 100 degrees relative the first side surface).

Figure 4:
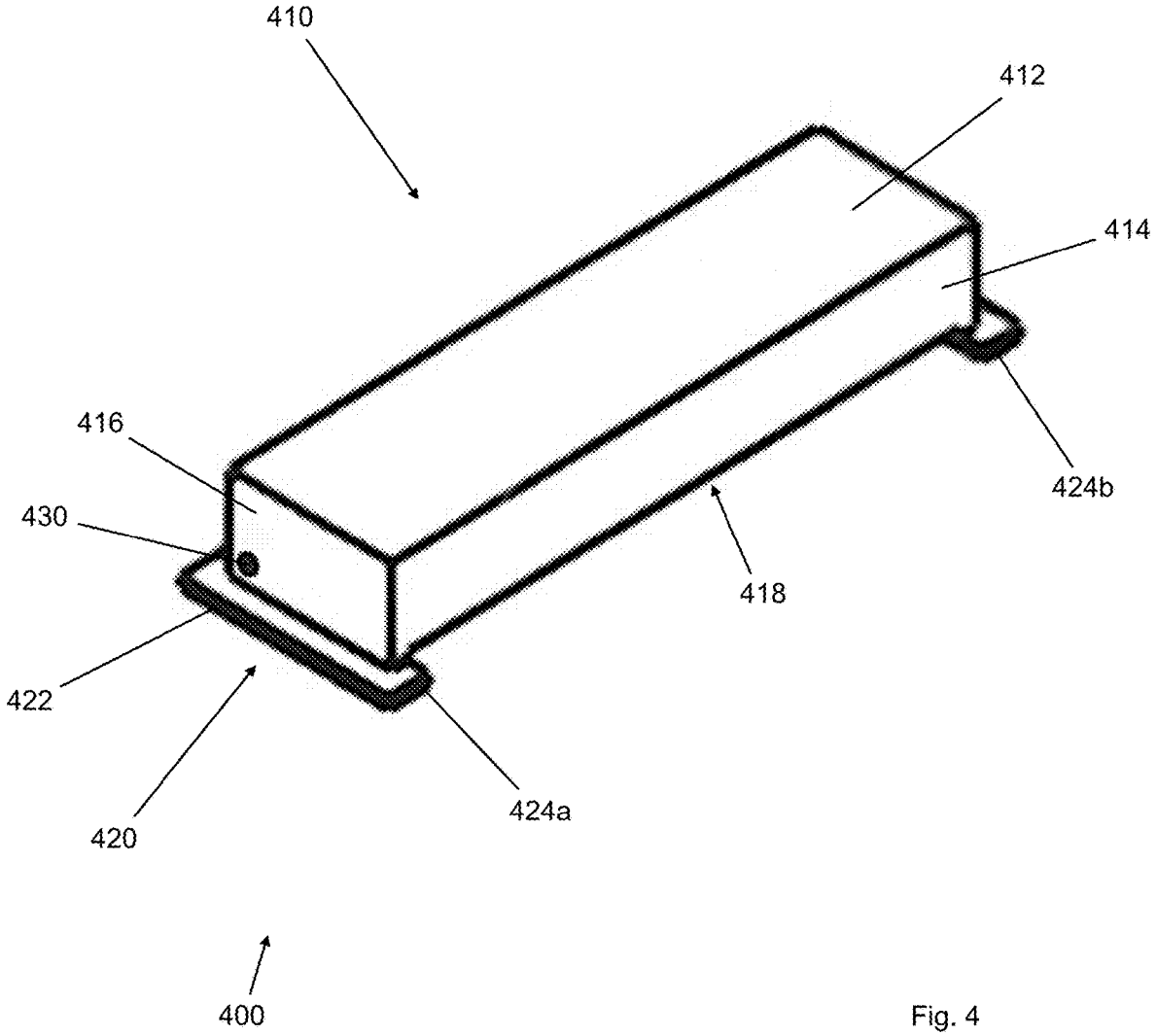
FIG. 4 illustrates a perspective view of a baffle retainer of a plurality of baffle structures of a watercraft baffle arrangement system in accordance with some embodiments of the present invention.

As shown in FIG. 4, a perspective view of a baffle retainer 400 of an array of baffle structures of a watercraft baffle arrangement system is provided. The baffle retainer 400 may comprise a housing 410 coupled to a perimeter flange 420. The housing 410 may comprise a top surface 412, a front surface 414, a back surface, a left side surface 416, and a right side surface that all collectively define a cavity therein. The front surface 414 may comprise a concave lower portion 418 that defines an opening into the cavity.

The housing 410 may be coupled to the perimeter flange 420 via a three-sided lip 422 that extends away from the exterior of the housing 410 as shown in FIG. 4. The three-sided lip 422 may terminate at first and second peninsula structures 424*a*, 424*b* which demarcate the beginning of the opening that is also partly defined by the concave lower portion 418 of the front surface 414 of the housing 410. The opening allows a baffle panel (not shown) illustrated in FIGS. 1-3, to pass therethrough when oriented in the closed configuration.

A coupling aperture 430 may be disposed within the left side surface 416 and the opposite right side surface to allow the baffle panel to be coupled and retained therein while still allowing for the baffle panel to rotate within the single degree of freedom of movement back and forth between the open and closed configurations. The opening formed within the front surface 414 of the housing 410 via the concave lower portion 418 is advantageous in that it allows the baffle panels to attain a closed configuration that is closer to parallel with the first side surface of FIGS. 1-3 which minimizes the amount of drag force experienced by the user when paddling against the water current.

Figure 5:
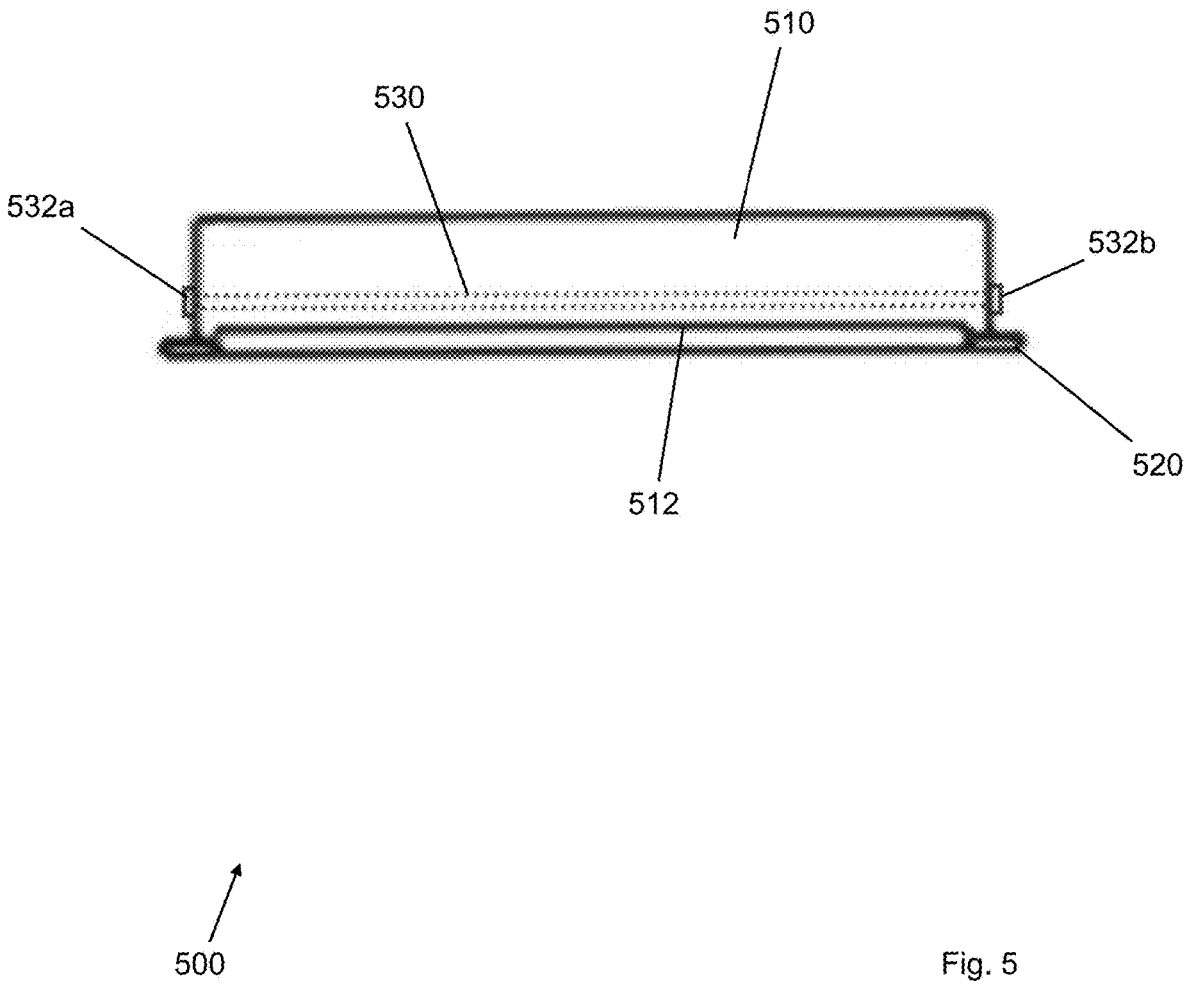
FIG. 5 illustrates an elevational view of a baffle retainer of a plurality of baffle structures of a watercraft baffle arrangement system in accordance with some embodiments of the present invention.

As shown in FIG. 5, an elevational view of a baffle retainer 500 of an array of baffle structures of a watercraft baffle arrangement system is provided. The baffle retainer 500 may comprise a housing 510 coupled to a perimeter flange 520. The housing 510 may comprise a concave lower portion 512 on one side of the housing 510 that collectively with the perimeter flange 520 may define an opening for accessing a cavity within the housing 510. The cavity may be defined by the plurality of walls that make up the structure of the housing 510 as illustrated in FIG. 5.

A coupling aperture may be disposed through each side of the housing 510 to allow a coupling rod 530 to be disposed therein. The coupling rod 530 may be utilized to couple a baffle panel thereto. Alternatively, the baffle panel may be structurally unitary, monolithic and continuous with the coupling rod 530 in order that the baffle panel be directly coupled into the coupling apertures of the housing 510. Further, the coupling rod 530 may be secured within the coupling apertures via first and second fasteners 532*a*, 532*b*. The coupling rod 530 and fasteners 532*a*, 532*b* may be secured within the coupling apertures of the housing 510 such that they are free to rotate about an axis running axially along the length of the coupling rod 530 which allows the baffle panel to rotate within the single degree of freedom of movement between open and closed configurations.

It is to be understood that the opening defined by the lower concave portion 512 and the remainder of the housing 510 may be shaped to have a larger dimension in order to allow a baffle panel to pass therethrough and be aligned substantially parallel to a first side surface of a watercraft body of the watercraft baffle arrangement system as described with respect to FIGS. 1-3. Specifically, a common plane passing through both of the coupling rod 530 and the opening may be aligned in parallel with the first side surface of the watercraft body. In the closed configuration, the baffle panel may be aligned within this common plane.

Figure 6:
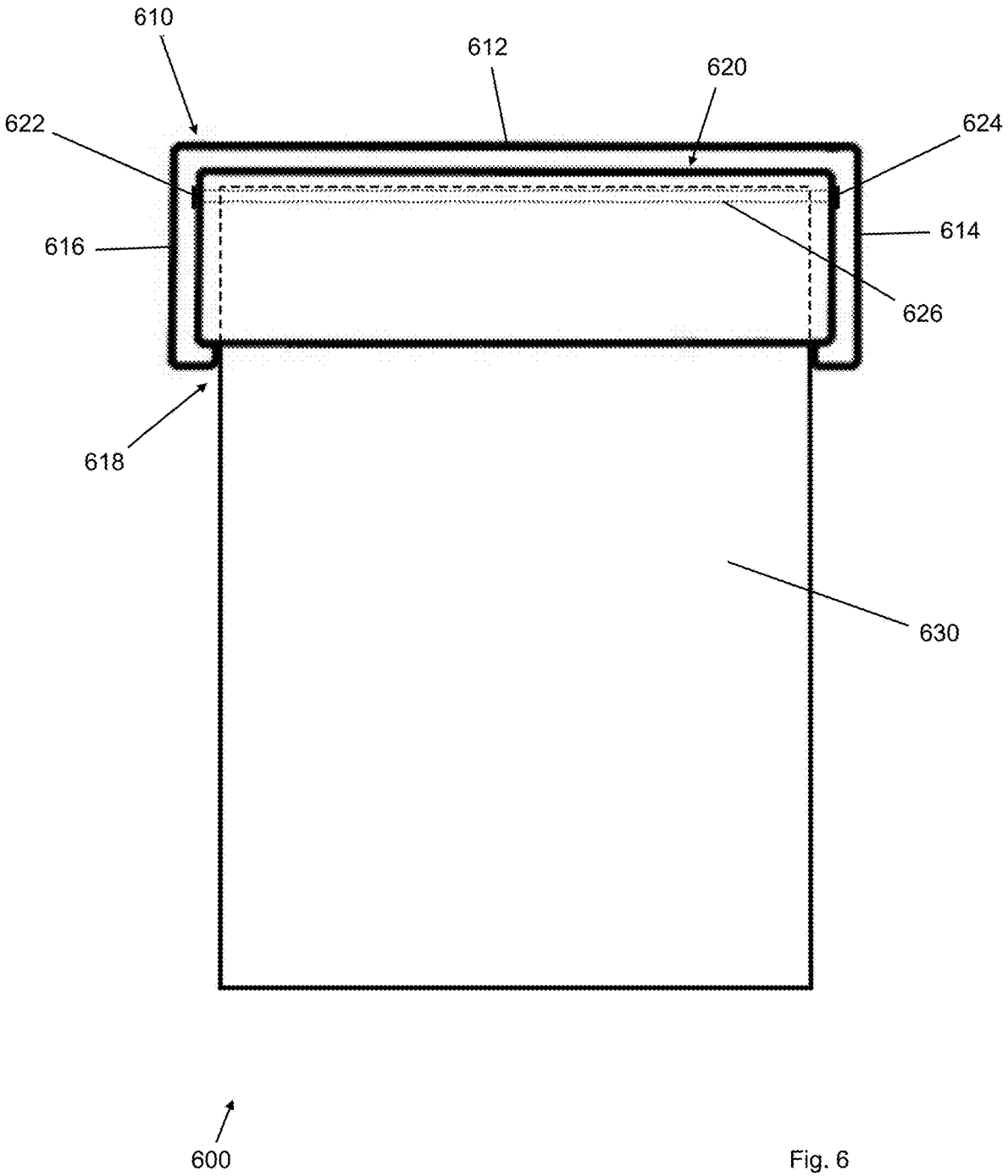
FIG. 6 illustrates an overhead view of a baffle structure of an array of baffle structures of a watercraft baffle arrangement system in accordance with some embodiments of the present invention.

As shown in FIG. 6, an overhead view of a baffle structure 600 of an array of baffle structures of a watercraft baffle arrangement system is provided. The baffle structure 600 may comprise a perimeter flange 610 coupled to a housing 620. The perimeter flange 610 may comprise a first side 612, a second side 614 and a third side 616 such that the first side 612 connects the second and third sides 614, 616 and the second side 614 is disposed opposite that of the third side 616.

The second and third sides 614, 616 along with the housing 620 may collectively define an opening 618 through which a baffle panel 630 may be disposed. When the baffle panel 630 is disposed through the opening 618 the baffle panel 630 is considered to be in a closed configuration. FIG. 6 illustrates the baffle panel 630 in such a closed configuration. Further, the baffle panel 630 may be coupled to the housing 620 via a coupling rod 626 which is secured to the housing via coupling apertures and first and second fasteners 622, 624.

As is illustrated in FIG. 6 via dashed line, the baffle panel 630 may be partially disposed within the housing 620 when it is oriented in the closed configuration. Similarly, the baffle panel 630 may be partially disposed within the housing 620 when it is oriented in an open configuration. However, a majority of the baffle panel 630 is disposed outside of the housing 620 when oriented in either the open or closed configurations. It is advantageous that a majority of the surface area of the baffle panel 630 be disposed outside of the housing 620 so that a larger surface area of the baffle panel 630 is exposed to moving water incident thereupon in order to more expeditiously propel a watercraft body within which the array of of baffle structures is disposed.

Figure 7:
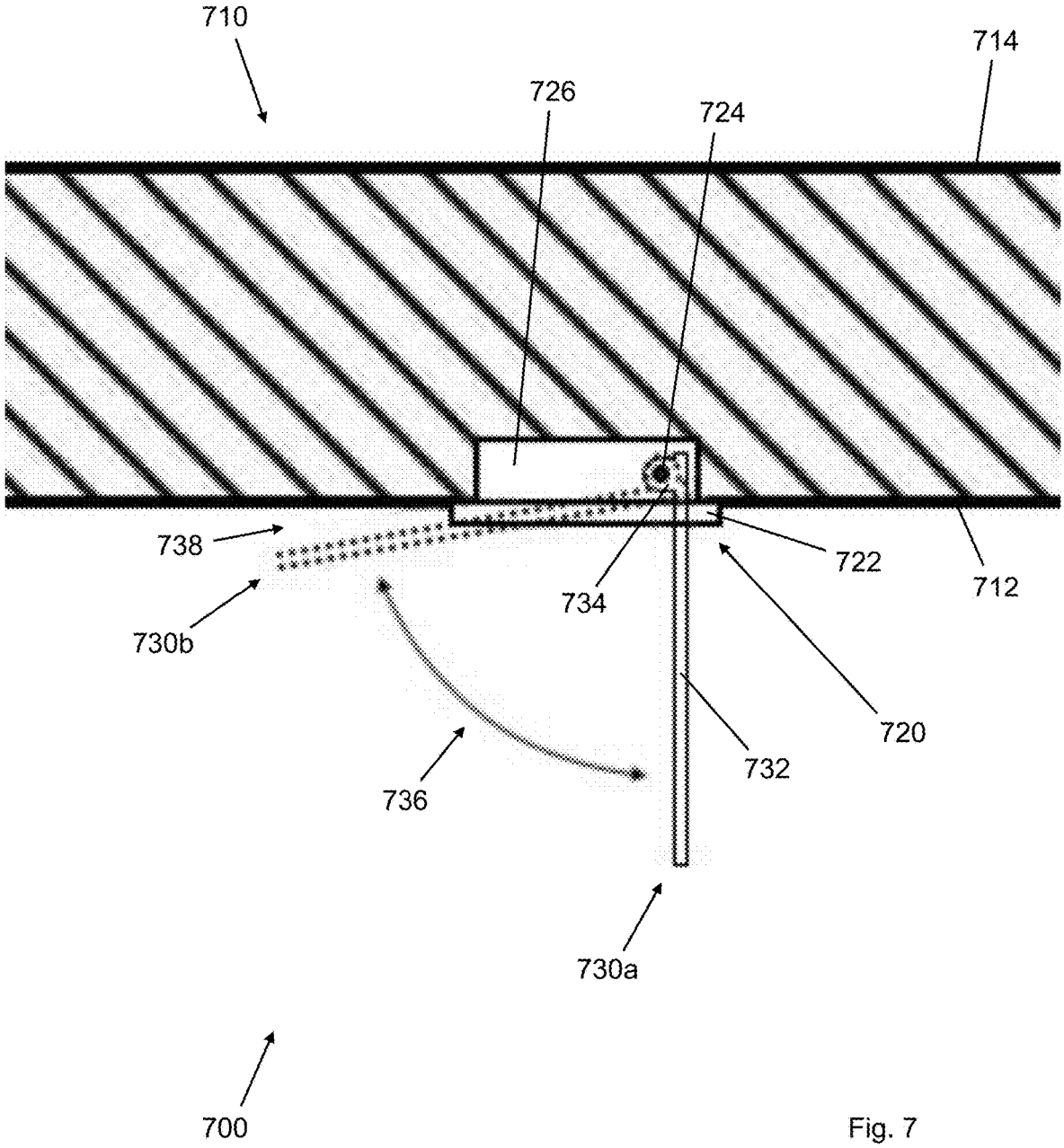
FIG. 7 illustrates a partial cross-sectional view of a baffle structure of an array of baffle structures coupled within a watercraft body of a watercraft baffle arrangement system in accordance with some embodiments of the present invention.

As shown in FIG. 7, a partial cross-sectional view of a baffle structure with a baffle panel coupled within a watercraft body 710 of a watercraft baffle arrangement system 700 is provided. The watercraft baffle arrangement system 700 may comprise a watercraft body 710 having a first side surface 712 and an opposing second side surface 714. The first side surface 712 may comprise a baffle structure 720 disposed therein having a baffle retainer and a baffle panel.

The baffle retainer may comprise a perimeter flange 722 coupled to a housing 726 which may define a cavity therein. The baffle panel may be disposed partially within the cavity and may be coupled to the housing via a coupling aperture 724. As shown in FIG. 7, the housing 726 may be disposed within the interior of the watercraft body 710 through the first side surface 712 while the perimeter flange 722 may be disposed outside of the watercraft body 710 and upon the first side surface 712. Such a structural configuration is advantageous in that is provides a greater quantity of adjoining surface area between the baffle retainer and the watercraft body 710.

The baffle panel may comprise a baffle panel 732 and a convex coupling portion 734. The baffle panel is illustrated in FIG. 7 in both the open configuration 730*a* and the closed configuration 730*b*. The open configuration 730*a* is illustrated as the baffle panel 732 being in a parallel orientation relative the first side surface 712 of the watercraft body 710. The closed configuration 730*b* is illustrated as the baffle panel 732 being in a near-parallel orientation relative the first side surface 712 of the watercraft body 710. The near-parallel orientation of the closed configuration 730*b* may allow a gap 738 to exist between the first side surface 712 and the baffle panel 732.

It is advantageous to utilize the gap 738 so that moving water underneath the watercraft body 710 may enter the gap 738 and thereby be incident upon the baffle panel 732 and force the entirety of the baffle panel from the closed configuration 730*b* into the open configuration 730*a*. In the process of manipulating the baffle panel between the open and closed configurations 730*a*, 730*b*, the baffle panel 732 may articulate back and forth through a solid angle 736 of about 90 degrees. However, it is understood to be within the scope of this invention that the solid angle 736 may be within a 10 degree angle range of 90 degrees (i.e. between 80 degrees and 100 degrees).

Figure 8A:
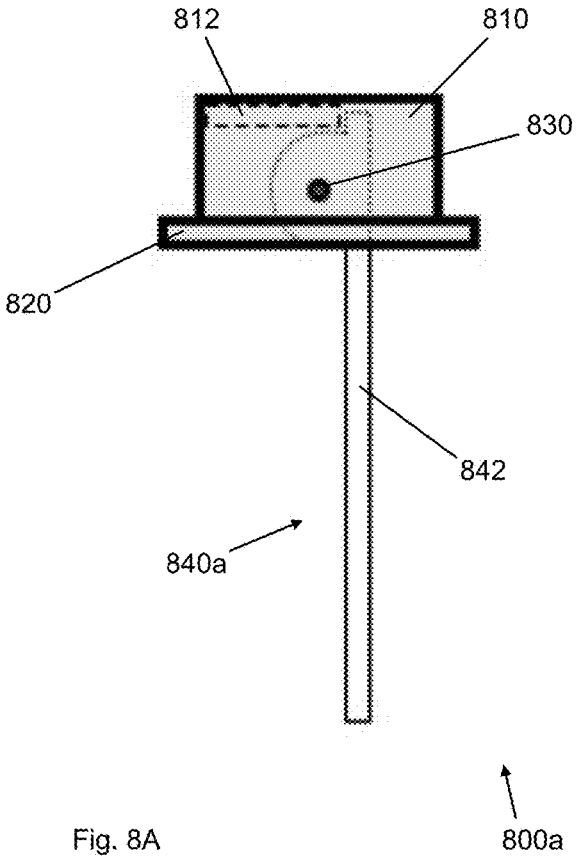
FIG. 8A illustrates a side elevational view of a baffle structure of an array of baffle structures in an open configuration in accordance with some embodiments of the present invention.

As shown in FIG. 8A, a side elevational view of a baffle structure 800*a* of an array of baffle structures in an open configuration 840*a* is provided. The baffle structure 800*a* may comprise a baffle retainer coupled to a baffle panel. The baffle retainer may comprise a housing 810 having an overlapping perimeter flange 820 coupled thereto and a stop structure 812 formed therein. The housing 810 may comprise a plurality of side walls, a top surface wall, and a bottom opening opposite that of the top surface wall. Two opposing walls of the plurality of side walls of the housing 810 may comprise a coupling aperture 830 that passes through each of these two opposing walls. Thereby, the coupling aperture 830 may be aligned within each of the two opposing walls to allow for a coupling rod to pass therethrough. The coupling rod may be aligned along a common axis with the coupling aperture 830.

The coupling rod may be utilized to secure the baffle panel to the baffle retainer. The baffle panel may comprise a baffle panel 842 extending from a convex coupling portion 844. The coupling rod may pass through a cylindrical cavity formed within convex coupling portion 844 such that the cylindrical cavity is aligned along the common axis with the coupling aperture 830. Thereby, both the baffle panel 842 and the convex coupling portion 844 may rotate in a single degree of freedom about the common axis and the coupling rod.

FIG. 8A illustrates the baffle panel in the open configuration 840*a* which is defined by the baffle panel 842 of the baffle panel being in an orthogonal 90 degree orientation relative the overlapping perimeter flange 820. The stop structure 812 formed within the cavity of the housing 810 may structurally prevent the baffle panel 842 from rotating past the orthogonal 90 degree orientation. However, depending upon the specific construction and shape of the stop structure 812, the baffle panel 842 may be allowed to rotate into a substantially orthogonal 90 degree orientation relative the overlapping perimeter flange 820. The phrase "substantially orthogonal 90 degree orientation" may include an angle range within 10 degrees of 90 degrees (i.e. between 80 degrees and 100 degrees). For purposes of capturing the kinetic energy of incident moving water, having the baffle panel 842 arranged within an angle range of 80 degrees to 100 degrees relative the overlapping perimeter flange 820 is sufficient.

In such a circumstance, the moving water is directionally moving from the convex coupling portion 844 side of the baffle panel towards the baffle panel 842 side of the baffle panel, thereby forcing the baffle panel 842 into the open configuration and maintaining it in such a configuration. In use of the surfboard baffle arrangement system, this circumstance may arise when a user of the system is attempting to catch a wave with the aide of the baffle panels 842 of the array of baffle structures in the open configuration 840*a*.

Figure 8B:
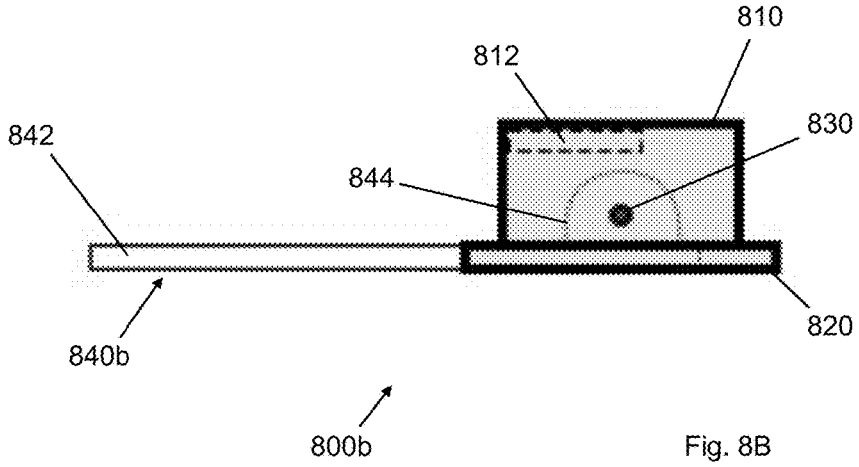
FIG. 8B illustrates a side elevational view of a baffle structure of an array of baffle structures in a closed configuration in accordance with some embodiments of the present invention.

As shown in FIG. 8B, a side elevational view of a baffle structure 800*b* of an array of baffle structures in a closed configuration 840*b* is provided. The baffle structure 800*b* of FIG. 8B may be the same or similar as that illustrated and described with respect to FIG. 8A. However, the baffle structure 800*b* of FIG. 8B shows the baffle panel oriented in the closed configuration 840*b* which is defined by the baffle panel 842 of the baffle panel being in a parallel orientation relative the overlapping perimeter flange 820 as shown in FIG. 8B.

Specifically, the concave lower portion defining the opening (illustrated and described with respect to FIGS. 4-6) within the housing 810 may prevent the baffle panel 842 from rotating past the parallel orientation. However, depending upon the specific construction and shape of the concave lower portion and opening, the baffle panel 842 may be allowed to rotate into a substantially parallel orientation relative the overlapping perimeter flange 820. The phrase "substantially parallel orientation" may include an angle range within 10 degrees of parallel (i.e. between −10 degrees and 10 degrees relative the overlapping perimeter flange 820).

For purposes of preventing the capture of kinetic energy of incident moving water, having the baffle panel 842 arranged within an angle range of −10 degrees and 10 degrees relative the overlapping perimeter flange 820 is sufficient. In such a circumstance, the moving water is directionally moving from the baffle panel 842 side of the baffle panel towards the convex coupling portion 844 side of the baffle panel, thereby forcing the baffle panel 842 into the closed configuration and maintaining it in such a configuration. In use of the surfboard baffle arrangement system, this circumstance may arise when a user of the system is attempting to paddle out into the ocean against incoming waves which would be much more difficult if the baffle panels 842 of the array of baffle structures were not kept in the closed configuration 840*b* to reduce water drag resistance.

Figure 9:
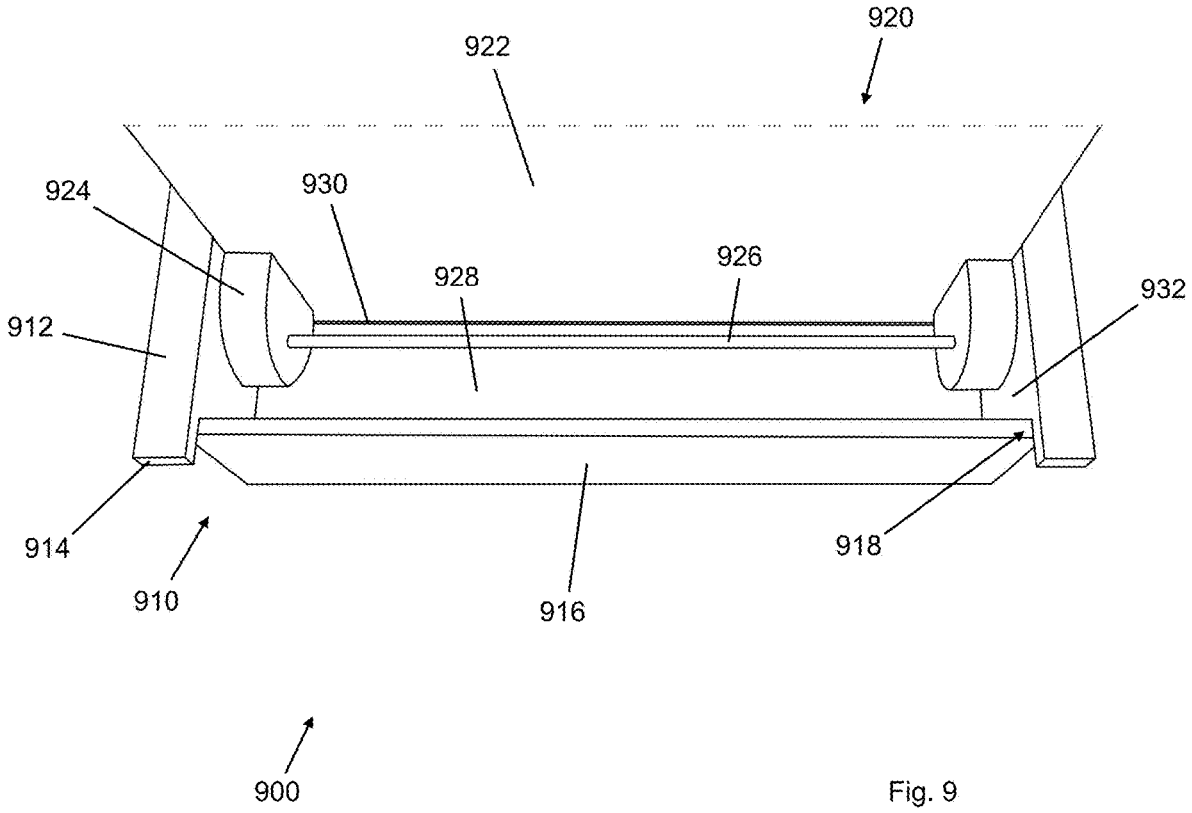
FIG. 9 illustrates a top perspective view of a baffle structure of an array of baffle structures in an open configuration in accordance with some embodiments of the present invention.

As shown in FIG. 9, a top perspective view of a baffle structure 900 of an array of baffle structures in an open configuration is provided. The baffle structure 900 may comprise a baffle retainer 910 and a baffle panel 920. The baffle retainer 910 may comprise a perimeter flange 912 having a three-sided rectangular shape which terminates at opposing first and second peninsula structures 914 which may overhang a front wall 916 as illustrated in FIG. 9. The first and second peninsula structures 914 overhanging the front wall 916 may define a structural opening 918 therebetween. The structural opening 918 in the baffle retainer 910 allows the baffle panel 920 to rest against a top surface of the front wall 916 when in the closed configuration. In this closed configuration, an elongate planar member 922 (shown in part) of the baffle panel 920 may sit flush against the top surface of the front wall 916 and with the top surface of the perimeter flange 912. Thereby, the baffle panel 920 may be placed into a substantially parallel position relative the perimeter flange 912 when the baffle panel 920 is in the closed configuration.

The baffle panel 920 may comprise the elongate planar member 922 coupled to opposing first and second rotational mount structures 924 which comprise apertures formed therein. These apertures are aligned along a common axis in order to allow a coupling rod 926 to pass therethrough. The coupling rod 926 may pass through the apertures of the first and second rotational mount structure 924 as well as the opposing first and second sidewalls 932 extending downward from the perimeter flange 912. The sidewalls 932 may also have apertures aligned along the common axis. In some embodiments, the coupling rod 926 may pass through the entirety of the opposing first and second sidewalls 932 and into the interior material of a watercraft body (not shown) described and illustrated in one embodiment with reference to FIGS. 1-3. It is understood that the watercraft may take the form of any vessel that travels on water. Preferably, the watercraft is a vessel that does not comprise propulsive capability but rather is propelled via water incident thereupon or via manual propulsion such as by rowing with one or more oars.

FIG. 9 illustrates the baffle panel 920 in the open configuration. In this open configuration, the baffle panel 920 may be arranged in a substantially orthogonal orientation relative the top surface of the perimeter flange 912 and in a substantially parallel orientation relative the front wall 916 as illustrated in FIG. 9. The baffle panel 920 is prevented from rotating past the open configuration via a stop structure 928 formed into a portion of a bottom wall of the baffle retainer 910. The stop structure 928 may be shaped as a step disposed upon the bottom wall which is designed to catch a proximal end of the elongate planar member 922 of the baffle panel 920 at a stop junction 930. The dimensions of the stop structure 928 are such that the stop junction 930 is formed to allow the baffle panel 920 to rotate into the open configuration but not to rotate past the open configuration. It would be disadvantageous to allow the baffle panel 920 to rotate past the open configuration considering this would decrease the propulsive effects of incident moving water upon the baffle panel 920 disposed in the open configuration.

Figure 10:
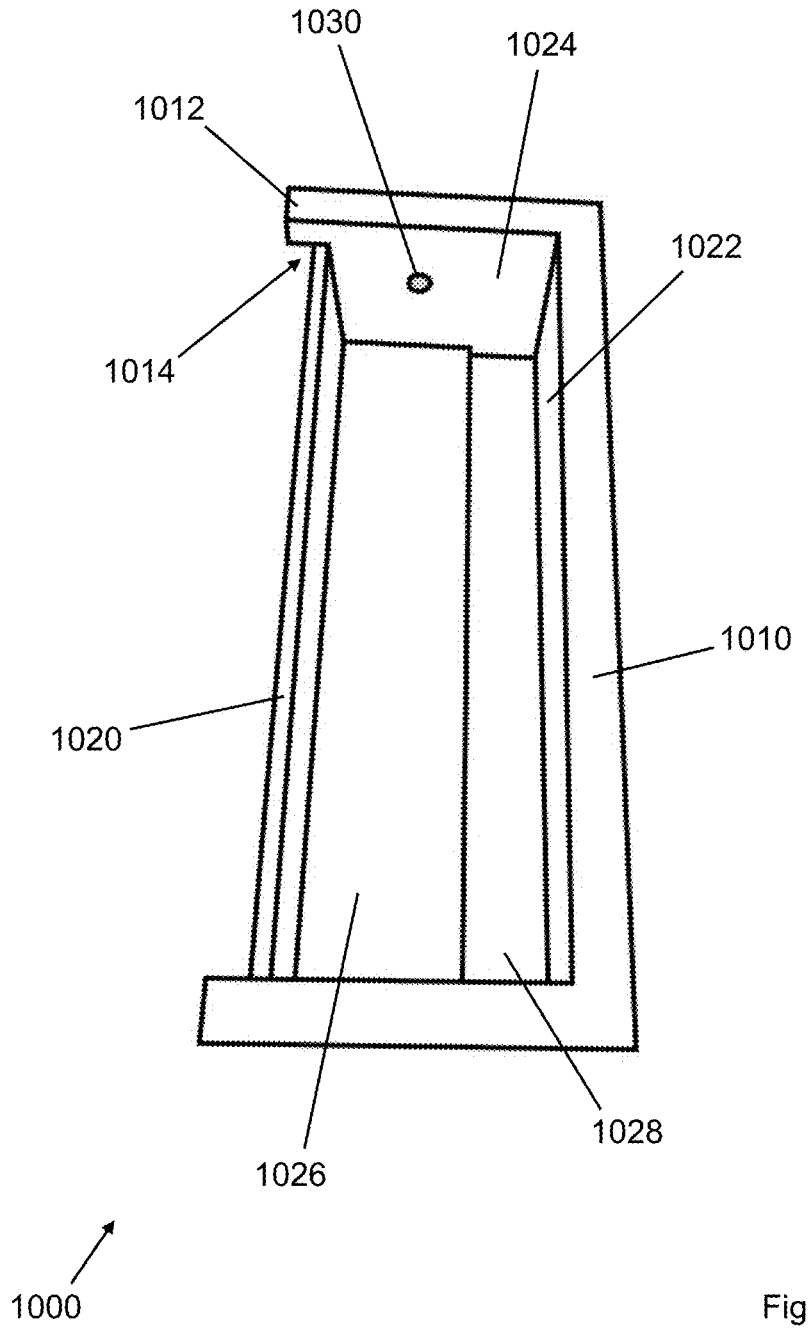
FIG. 10 illustrates a side perspective view of a baffle retainer of a baffle structure without the baffle panel attached in accordance with some embodiments of the present invention.

As shown in FIG. 10, a side perspective view of a baffle retainer 1000 of a baffle structure without the baffle panel attached is provided. The baffle retainer 1000 may comprise a perimeter flange 1010 having a three-sided rectangular shape which terminates at opposing first and second peninsula structures 1012 which may overhang a top surface of a front wall 1020 as illustrated in FIG. 10. The first and second peninsula structures 1012 overhanging the top surface of the front wall 1020 may define a structural opening 1014 therebetween. The front wall 1020 may comprise an opposing back wall 1022 and adjacent sidewalls 1024. The front wall 1020 may be disposed adjacent a stop structure 1026 while the back wall may be disposed adjacent a bottom wall 1028. Further, the sidewalls 1024 may be disposed adjacent both the stop structure 1026 as well as the bottom wall 1028. The sidewalls 1024 may each comprise a coupling aperture 1030 disposed therethrough which are aligned with one another along a common axis.

The stop structure 1026 may cover a majority of the surface area of the bottom wall 1028 so that the stop structure 1026 may effectively cease rotation of a baffle panel once the baffle panel has reached the open configuration. It would be disadvantageous to allow the baffle panel to rotate past the open configuration considering this would decrease the propulsive effects of incident moving water upon the baffle panel disposed in the open configuration. Therefore, it would be disadvantageous for the stop structure 1026 not to cover a majority of the surface area of the bottom wall 1028. More specifically, considering the stop structure 1026 may be shaped to be a rectangle, it is advantageous that the width of the rectangular strop structure 1026 may be dimensionally larger than the distance from the front or back walls 1020, 1022 to the width-wise midpoint of the bottom wall 1028 as is illustrated in FIG. 10.

Figure 11A:
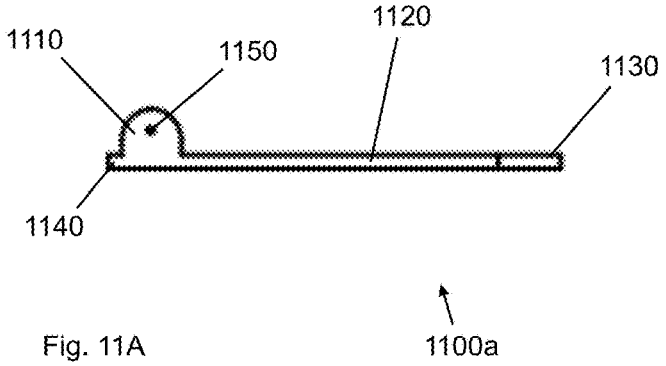
FIG. 11A illustrates a side elevational view of a baffle panel of a baffle structure in accordance with some embodiments of the present invention.

As shown in FIG. 11A, a side elevational view of a baffle panel 1100*a* of a baffle structure is provided. The baffle panel 1100*a* may comprise first and second rotational mount structure 1110 extending from a first side of a proximal portion of an elongate planar member 1120 of the baffle panel 1100*a*. The elongate planar member 1120 may comprise a curved distal end 1130 which provides allows the member 1120 to be more hydrodynamic in water and reduce the amount of water resistance experienced when moving through water. The elongate planar member 1120 may comprise a proximal flange end 1140 disposed adjacent the rotational mount structures 1110 as shown in FIG. 11A. Each of the rotational mount structures 1110 may comprise an aperture 1150 disposed therethrough which are each aligned about a common axis.

Figure 11B:
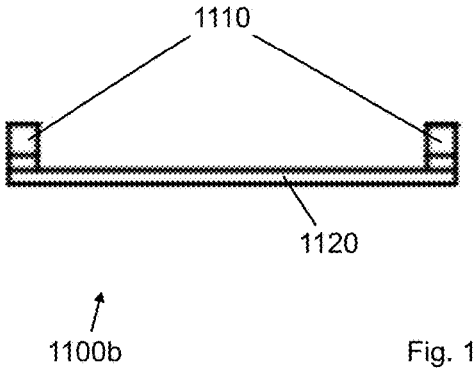
FIG. 11B illustrates a rear elevational view of a baffle panel of a baffle structure in accordance with some embodiments of the present invention.

As shown in FIG. 11B, a rear elevational view of a baffle panel 1100*b* of a baffle structure is provided. The baffle panel

1100*b* may comprise first and second rotational mount structure 1110 extending from a first side of a proximal portion of an elongate planar member 1120 of the baffle panel 1100*a*. Each of the rotational mount structures 1110 may be disposed at left and right terminal edges of the elongate planar member 1120. While it is preferred to utilize two rotational mount structures 1110 for purposes of reduced material fabrication costs and structural robustness concerns, it is understood that a single mount structure may be utilized that runs across the width of the planar elongate member 1120 or that more than two mount structures may be utilized across the width of the member 1120 so long as each of the apertures within the mount structures are aligned along the common axis.

Figure 11C:
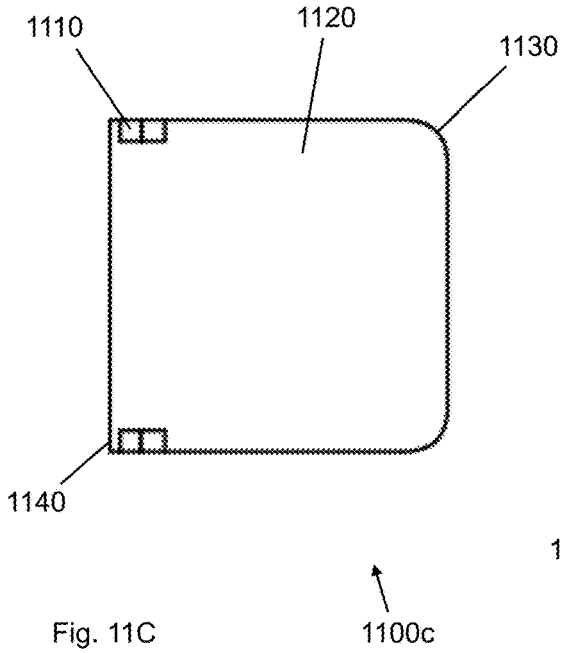
FIG. 11C illustrates a plan view of a baffle panel of a baffle structure in accordance with some embodiments of the present invention.

As shown in FIG. 11C, a plan view of a baffle panel 1100*c* of a baffle structure is provided. The baffle panel 1100*c* may comprise first and second rotational mount structures 1110 extending from a first side of a proximal portion of an elongate planar member 1120 of the baffle panel 1100*a*. The elongate planar member 1120 may comprise a curved distal end 1130 with rounded corners which provides allows the member 1120 to be more hydrodynamic in water and reduce the amount of water resistance experienced when moving through water. The elongate planar member 1120 may comprise a proximal flange end 1140 disposed adjacent and beyond the position of the rotational mount structures 1110 as shown in FIG. 11A.

Figure 11D:
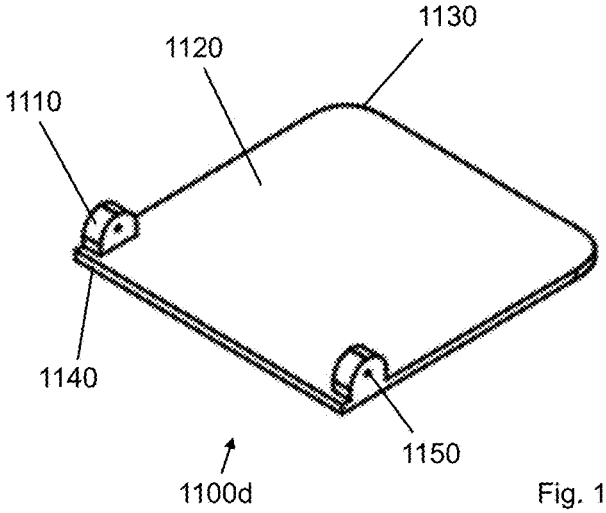
FIG. 11D illustrates a perspective view of a baffle panel of a baffle structure in accordance with some embodiments of the present invention.

As shown in FIG. 11D, a perspective view of a baffle panel 1100*d* of a baffle structure is provided. The baffle panel 1100*a* may comprise first and second rotational mount structure 1110 extending from a first side of a proximal portion of an elongate planar member 1120 of the baffle panel 1100*a*. While the rotational mount structures 1110 are shown to be roughly hemicylindrical in shape, it is understood that the mount structures 1110 may be any suitable shape so long as they do not interfere with the rotation of the baffle panel of previous embodiments between open and closed configurations. Given the dimensions of the baffle retainer of previous embodiments, it is advantageous that the rotational mount structures 1110 be hemicylindrical in order to minimize their form factor and prevent interference of the baffle panel rotation which in turn minimizes the allowed form factor for the baffle retainer which minimizes material fabrication costs.

The elongate planar member 1120 may comprise a curved distal end 1130 which provides allows the member 1120 to be more hydrodynamic in water and reduce the amount of water resistance experienced when moving through water. The elongate planar member 1120 may comprise a proximal flange end 1140 disposed adjacent the rotational mount structures 1110 as shown in FIG. 11A. The distance from which the proximal flange 1140 extends beyond the rotational mount structures 1110 may be determined by the height of the stop structure of the baffle retainer as described and illustrated in previous embodiments. It is advantageous, and thus preferred, that the proximal flange 1140 not have a height dimension greater than that of the stop structure so as not to interfere with the rotation of the baffle panel. Further, it is advantageous that the rotational mount structures 1110 be disposed along the elongate planar member 1120 at a height dimension larger than that of stop structure so as to allow the structures 1110 to sit above the stop structure (thereby not interfering) when the baffle panel is placed in the open configuration. Each of the rotational mount structures 1110 may comprise an aperture 1150 disposed therethrough which are each aligned about a common axis.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All features disclosed in the specification, claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "coupled" or"connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A surfboard baffle arrangement system, comprising:

a watercraft body having a first side surface and a second side surface; and an array of baffle structures disposed into the watercraft body and through the first side surface, wherein:

each baffle structure within the array of baffle structures comprises a baffle retainer and a baffle panel, the baffle panel and the baffle retainer are operably coupled to one another, the baffle panel comprises one degree of freedom of rotation relative the baffle retainer, the one degree of freedom of rotation comprises rotation of the baffle panel between an open configuration and a closed configuration, the baffle panel and the baffle retainer are operably coupled to one another via a coupling rod, the coupling rod is secured to the baffle retainer via a plurality of coupling apertures formed within the baffle retainer, the baffle retainer comprises a housing and a perimeter flange, and the plurality of coupling apertures are disposed within opposing second and third walls of the housing.

2. The surfboard baffle arrangement system of claim 1, wherein the first side surface is opposite the second side surface.

3. The surfboard baffle arrangement system of claim 1, wherein the array of baffle structures is disposed into the watercraft body and through the first side surface but not the second side surface.

4. The surfboard baffle arrangement system of claim 1, wherein the housing and the perimeter flange are permanently coupled to one another.

5. The surfboard baffle arrangement system of claim 1, wherein the housing comprises a first wall having a lower concave portion defining an opening to a cavity within the housing.

6. The surfboard baffle arrangement system of claim 1, wherein the perimeter flange is disposed outside of the watercraft body and upon the first side surface.

7. The surfboard baffle arrangement system of claim 1, wherein the array of baffle structures is arranged symmetric about a vertical axis running along the width-wise midpoint of the watercraft body.

8. The surfboard baffle arrangement system of claim 1, wherein the array of baffle structures is arranged asymmetric about a horizontal axis running along the length-wise midpoint of the watercraft body.

9. The surfboard baffle arrangement system of claim 1, wherein the plurality of coupling apertures are aligned along a common axis.

10. The surfboard baffle arrangement system of claim 9, wherein the common axis is aligned axially along the length of the coupling rod.

11. The surfboard baffle arrangement system of claim 1, wherein:

the coupling rod comprises one degree of freedom of rotation relative the housing.

12. The surfboard baffle arrangement system of claim 1, wherein:

the housing comprises a first wall having a lower concave portion defining an opening to a cavity within the housing, and the coupling rod is entirely disposed within the cavity.

13. The surfboard baffle arrangement system of claim 12, wherein the baffle panel is only partially disposed within the cavity.

14. The surfboard baffle arrangement system of claim 1, wherein:

the housing comprises a cavity therein and each of the housing and the cavity are disposed within the watercraft body, and the perimeter flange is disposed outside of the watercraft body and upon the first side surface.

15. A surfboard baffle arrangement system, comprising:

a watercraft body having a first side surface and a second side surface, wherein the first side surface is opposite the second side surface; and an array of baffle structures disposed into the watercraft body and through the first side surface but not the second side surface, wherein:

each baffle structure within the array of baffle structures comprises a baffle retainer and a baffle panel, the baffle retainer comprises a housing and a perimeter flange, the housing and the perimeter flange are permanently coupled to one another, the baffle panel and the baffle retainer are operably coupled to one another via a coupling rod, the baffle panel comprises one degree of freedom of rotation relative the baffle retainer, the one degree of freedom of rotation comprises rotation of the baffle panel between an open configuration and a closed configuration, the coupling rod is secured to the baffle retainer via a plurality of coupling apertures formed within the baffle retainer, and the plurality of coupling apertures are disposed within opposing second and third walls of the housing.

16. A surfboard baffle arrangement system, comprising:

a watercraft body having a first side surface and a second side surface, wherein the first side surface is opposite the second side surface; and an array of baffle structures disposed into the watercraft body and through the first side surface but not the second side surface, wherein:

each baffle structure within the array of baffle structures comprises a baffle retainer and a baffle panel, the baffle retainer comprises a housing and a perimeter flange, the housing comprises a first wall having a lower concave portion defining an opening to a cavity within the housing, the perimeter flange is disposed outside of the watercraft body and upon the first side surface, the baffle panel and the baffle retainer are operably coupled to one another via a coupling rod, the baffle panel comprises one degree of freedom of rotation relative the baffle retainer, the one degree of freedom of rotation comprises rotation of the baffle panel between an open configuration and a closed configuration, the coupling rod is secured to the baffle retainer via a plurality of coupling apertures formed within the baffle retainer, and the plurality of coupling apertures are disposed within opposing second and third walls of the housing.

* * * * *